US012270625B1

(12) United States Patent
Ding et al.

(10) Patent No.: US 12,270,625 B1
(45) Date of Patent: Apr. 8, 2025

(54) ROTATABLE BUTTSTOCK

(71) Applicant: Leapers, Inc., Livonia, MI (US)

(72) Inventors: Tai-lai Ding, Northville, MI (US); Tat Shing Yu, Plymouth, MI (US); Horatiu Popa, Napoca (RO)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 18/912,835

(22) Filed: Oct. 11, 2024

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/08; F41C 23/06; F41C 23/20; F41C 23/04; F41C 23/10; F41C 23/00; F41A 11/02; F41A 17/46; F41A 23/10
USPC ..... 42/75.03, 71.01–74, 75.01
See application file for complete search history.

(56) References Cited

U.S. PATENT DOCUMENTS 1,430,661 A * 10/1922 Lewis ..... F41A 13/02 89/193
1,457,961 A * 6/1923 Browning ..... F41A 17/46 89/184
1,533,966 A * 4/1925 Browning ..... F41A 17/36 89/138
2,090,340 A * 8/1937 Browning ..... F41A 5/02 42/21
2,121,982 A * 6/1938 Pugsley ..... F41C 23/14 33/506
2,400,349 A * 5/1946 Haberstump ..... F41C 23/04 42/72
3,707,797 A * 1/1973 Ruth ..... F41C 23/06 42/74
4,663,877 A * 5/1987 Bragg ..... F41C 23/06 42/74
4,896,446 A * 1/1990 Gregory ..... F41C 23/14 42/74
5,001,855 A * 3/1991 Griggs ..... F41C 23/08 42/74
5,367,812 A * 11/1994 Lautrec ..... F41C 23/14 42/74
5,711,102 A * 1/1998 Plaster ..... F41C 23/14 42/74

(Continued)

FOREIGN PATENT DOCUMENTS

WO 2023153950 A1 8/2023

*Primary Examiner* — Michael D David
(74) *Attorney, Agent, or Firm* — Warner Norcross + Judd LLP

(57) ABSTRACT

A rotatable buttstock mount can include a tube, a boss, a support frame including a rearward ring and a guide pin in a guide slot such that the support frame can rotate relative to the tube. When a buttstock is secured to the mount, the buttstock can rotate with the frame and thereby change the axial angle of the buttstock relative to the weapon to which the mount is secured, thereby providing a user with a variety of angular orientations of the buttstock for different shooting configurations. The mount can rotate freely relative to the tube, being actuated simply by overcoming a friction interface between components and/or a detent between the components. Thus, actuation of the mount and rotation of the buttstock to a custom angular position can be easily and quickly implemented to obtain a selected configuration for the user.

20 Claims, 9 Drawing Sheets

(56) References Cited

U.S. PATENT DOCUMENTS

| | | | | | |
|---|---|---|---|---|---|
| 5,752,339 | A * | 5/1998 | Bentley | F41C 23/06 | 42/74 |
| 6,684,549 | B2 * | 2/2004 | Bragg | F41C 23/08 | 42/74 |
| 6,688,031 | B2 * | 2/2004 | Steele | F41C 23/14 | 42/71.01 |
| 7,823,315 | B2 * | 11/2010 | Webber | F41A 11/02 | 42/72 |
| 7,930,849 | B2 * | 4/2011 | Abraham | F41C 23/14 | 42/73 |
| 8,720,099 | B1 * | 5/2014 | Sisk | F41C 23/14 | 42/73 |
| D773,005 | S * | 11/2016 | Ding | D22/108 | |
| D818,074 | S * | 5/2018 | Ding | D22/108 | |
| 10,323,897 | B1 * | 6/2019 | Ding | F41A 23/14 | |
| 10,345,060 | B2 | 7/2019 | Irvin | | |
| 10,393,467 | B1 * | 8/2019 | Ding | F41A 35/02 | |
| 10,612,880 | B1 * | 4/2020 | Ding | F41C 23/14 | |
| 11,428,492 | B1 * | 8/2022 | Ding | F41A 23/10 | |
| 11,592,264 | B1 * | 2/2023 | Ding | F41C 23/04 | |
| 2003/0154640 | A1 * | 8/2003 | Bragg | F41C 23/08 | 42/74 |
| 2003/0221352 | A1 * | 12/2003 | Steele | F41C 23/14 | 42/73 |
| 2006/0254112 | A1 * | 11/2006 | Snoderly | F41C 23/06 | 42/74 |
| 2007/0089347 | A1 * | 4/2007 | Webber | F41C 23/20 | 42/75.03 |
| 2008/0028662 | A1 * | 2/2008 | Abraham | F41C 23/14 | 42/74 |
| 2010/0132240 | A1 * | 6/2010 | Webber | F41C 23/20 | 29/592 |
| 2018/0080736 | A1 * | 3/2018 | Olsen | F41C 23/14 | |
| 2019/0056193 | A1 * | 2/2019 | Blake | F41C 23/08 | |
| 2021/0215451 | A1 * | 7/2021 | Ding | F41C 23/14 | |

* cited by examiner

ROTATABLE BUTTSTOCK

BACKGROUND OF THE INVENTION

The present invention relates to weapons, and more particularly to a mount for a buttstock on a weapon.

Many weapons that shoot projectiles, such as firearms, have a stock including a fore end that faces forward and a buttstock that faces rearward from a barrel and action of the weapon. The buttstock typically is configured to engage a user's shoulder when the user aims the weapon at a target. A common firearm including a buttstock is a modern sporting rifle. Such modern sporting rifles include a receiver or lower to which a buffer tube is fixedly secured. Many times, a collapsible buttstock is joined with the buffer tube and can be extended or retracted longitudinally away from or toward the receiver, generally being disposed in a fixed axial arrangement, to enable the rifle to fit the stature of the user.

With this configuration of the buttstock in a fixed axial arrangement, a user can point and aim the rifle in most normal upright shooting conditions. In doing so, the buttstock will set squarely against the user's shoulder with the rifle being disposed orthogonally to the user's body and its lower parts facing down toward the ground. However, when a user must use the rifle under cover, they will attempt to hold the rifle at non-orthogonal and non-ideal angles. This can occur when a user fires around a corner, under equipment or a vehicle, or in other tight spaces. In such conditions, the user may lay prone on the ground or on their side and attempt to hold the rifle parallel to the user's body and at an acute angle to the ground, which can cause the rifle to be oddly or uncomfortably placed against the user's shoulder. As a result, the user's shots with the rifle may be inaccurate or imprecise.

Accordingly, there remains room for improvement in the field of buttstocks to provide radial or rotational movement and adjustment in a simple and efficient mechanism that interfaces between the buttstock and the tube of a modern sporting rifle or similar weapon.

SUMMARY OF THE INVENTION

A rotatable buttstock mount is provided and can include a tube, a boss, a support frame including a ring and a guide pin in a guide slot such that the support frame can rotate axially about a longitudinal axis of the tube. When a buttstock is secured to the support frame, the buttstock can rotate with part of the frame and thereby change the axial angle of the buttstock relative to the weapon to which the mount is secured, thereby providing a user with a variety of angular orientations of the buttstock for different shooting situations.

In one embodiment, the mount can rotate freely relative to the tube, being actuated and initially overcoming a friction interface between components, a detent and/or other release mechanism between the components. Thus, actuation of the mount and rotation of the buttstock to a custom angular position can be easily and quickly implemented to obtain a selected configuration.

In another embodiment, the support frame can include a rail extending between a rearward ring and a forward ring extending around the tube forward of the boss. The buttstock can be joined with the rearward ring and slidably interfaced with the rail to provide variable extension of the buttstock relative to the tube. In some applications, the rail can include multiple extension recesses corresponding to the extension of the buttstock away from the tube and a weapon to which the tube is joined. The buttstock can include one or more extension recesses, into which an engagement post of the buttstock can be selectively positioned.

In still another embodiment, the guide pin and guide slot can be interfaced with one another between the boss and the rearward ring. The guide slot can be a linear slot that is transverse to the longitudinal axis of the tube. The linear slot can be perpendicular to the axis.

In another embodiment, the linear slot can curve around the axis from a first slot end to a second slot end. The linear slot can include one or more linear edges that are forward or rearward of the slot, bounding it. The linear edges can be perpendicular to the axis as well.

In yet another embodiment, the guide slot can be defined by the boss and/or a part of the tube, and the guide pin can be joined with the support frame, for example the rearward ring that can surround the boss. Alternatively, the guide slot and guide pin can be reversed on these components and still interface with one another.

In even another embodiment, the guide pin can include a threaded shaft having a head at a first end and a post at a second end. The post can be journaled in the guide slot and the threaded shaft can be outside the guide slot, threaded in at least one of the rings and the boss and thereby secured thereto.

In a further embodiment, the guide slot can be unbranched and linear, curving around the longitudinal axis. When unbranched, the guide slot can extend along an axis without separating or diverging to other slot portions, however, the guide slot can still curve around the longitudinal axis, for example in an arcuate form around that longitudinal axis.

In still a further embodiment, the rearward ring can be retained on the boss with a retainer. Between the retainer and the ring, a friction washer can be disposed. The friction washer can hold the ring in a relatively tight and unmoving configuration, but when a rotational force is applied, can also allow the ring to overcome a static friction interface and rotate relative to the boss to some angle selected by the user. In turn, the buttstock attached to the mount also can rotate to that angle. In some cases, the retainer includes a clip or other component joined with the boss and/or the tube.

In yet a further embodiment, the mount can include a cap joined with the boss rearward of the boss. A fastener can extend through the cap and thread to the boss to join the cap with the boss. The cap can define an internal cavity in which the retainer and/or friction washer are disposed.

In even a further embodiment, the support frame and the boss can include a detent interface including a bearing and a plurality of recesses disposed around the longitudinal axis and configured to selectively receive the bearing, thereby fixing the rearward ring one of several different angular orientations relative to the tube. Thus, the angle of a buttstock when joined with the support frame can be fixed at any one of the different angular orientations relative to the tube.

In another embodiment, the detent interface can include a bias member in a biasing relationship with the bearing. The bearing can roll along the face of the boss and into one of the recesses to set the support frame at a preselected angular orientation about the axis of the tube. The orientation can be offset from a configuration where the buttstock extends straight downward from the tube and lays in a vertical plane generally aligned with a receiver of the weapon, which can be a firearm, when in a vertical configuration.

The current embodiments provide a buttstock mount that efficiently and consistently mounts a buttstock to a weapon, such as a firearm, while allowing the buttstock to axially rotate about a longitudinal axis of the mount to a variety of different angular orientations. Where the mount is provided with a rearward ring, the user can rotate the ring and thus an attached buttstock simply by applying a moment or rotational force to do so, without pressing or longitudinally moving the buttstock and support frame axially along or parallel to the longitudinal axis of the tube. Where the mount includes a detent interface or other rotational locking or rotation impairing mechanism, the frame and the attached buttstock can be selectively temporarily set or locked in a particular angular orientation selected by a user, and easily further adjusted from that angular orientation.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
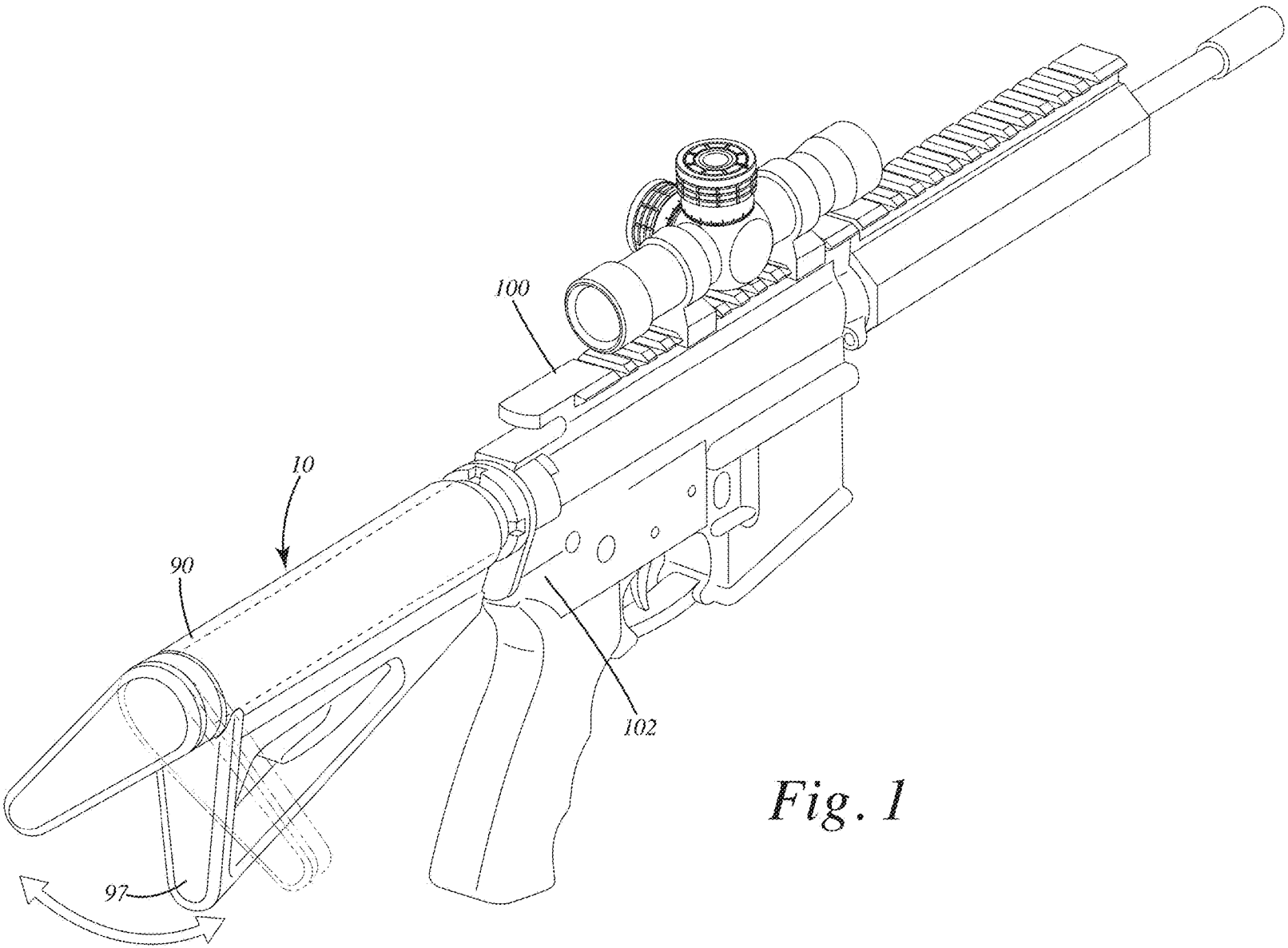
FIG. 1 is a perspective view of a buttstock mounted to a weapon such as a modern sporting rifle via the buttstock mount of a current embodiment.
Figure 2:
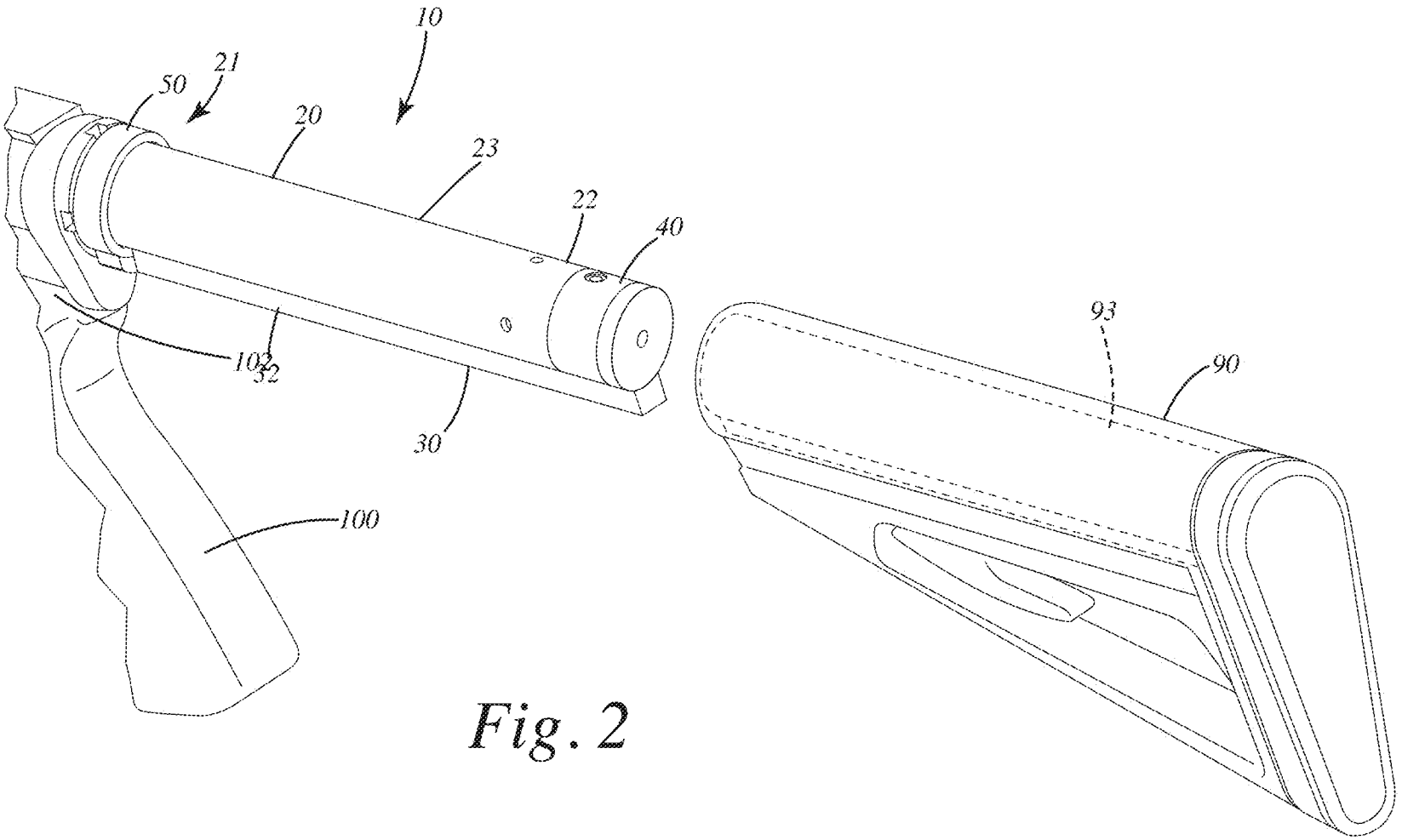
FIG. 2 is a perspective view of the buttstock removed from the buttstock mount.

A current embodiment of the buttstock mount mounting a buttstock to a weapon such as a firearm is shown in FIGS. 1-5 and generally designated 10. The buttstock mount 10 is shown installed on an AR-15 firearm 100, but the weapon with which the mount 10 is used can be any sporting, military or hunting rifle, pistol, shotgun or other type of weapon, such as a crossbow, airsoft gun, paint marker, or other projectile shooting device, all referred to herein as a weapon, that uses a tube or extension extending rearward from a receiver, stock, action or lower receiver 102 or other part of the weapon used to support or engage a buttstock 90 for shouldering or better holding the weapon.

As shown in FIGS. 1-4, the buttstock mount 10 can be used to mount a buttstock 90 to the weapon. The buttstock mount 10 can include a tube 20 which optionally can house a buffer and buffer spring (not shown) where the weapon is an AR style platform. In other applications, the tube can be solid or house other components. The tube 20 can include a forward end 21 and a rearward end 22 with a middle portion 23 disposed there between the forward end 21 can be threaded and or include threads to thread into a portion of the receiver or action or other portion of the weapon 100 the forward end 21 can be open and hollow to receive a buffer and a buffer spring associated with the weapon 100. The middle portion 23 can be hollow and can extend to the rearward end 22. Tube 20 can be cylindrical and round but can be of other geometric cross sections such as square, rectangular or some other polygonal shape. When cylindrical, the tube 20 can slidably fit inside a tubular and generally cylindrical compartment or bore 93 defined by the buttstock 90. The tube 20 can be coupled to a support frame 30 including a rearward ring 40 and an optional forward ring 50 that are joined via a bar or rail 32.

Figure 3:
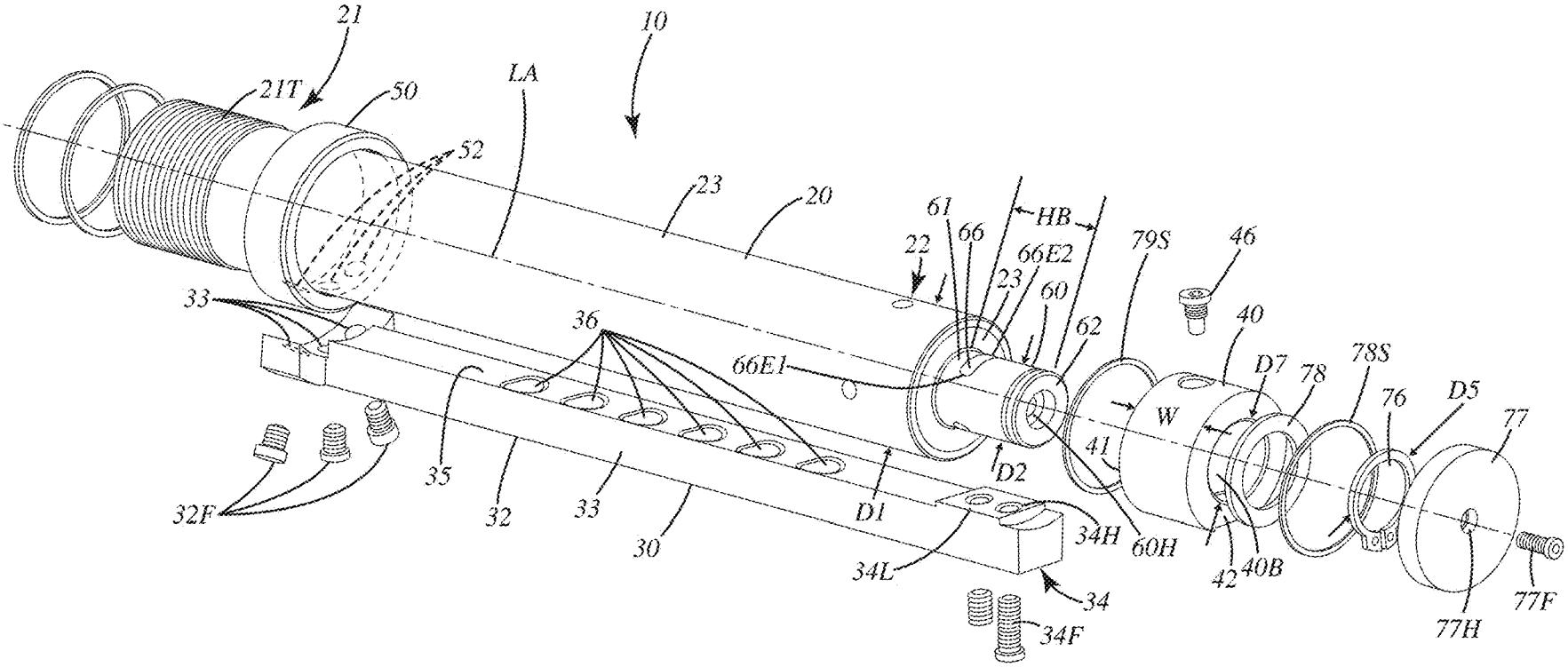
FIG. 3 is an upper exploded perspective view of the buttstock mount.
Figure 4:
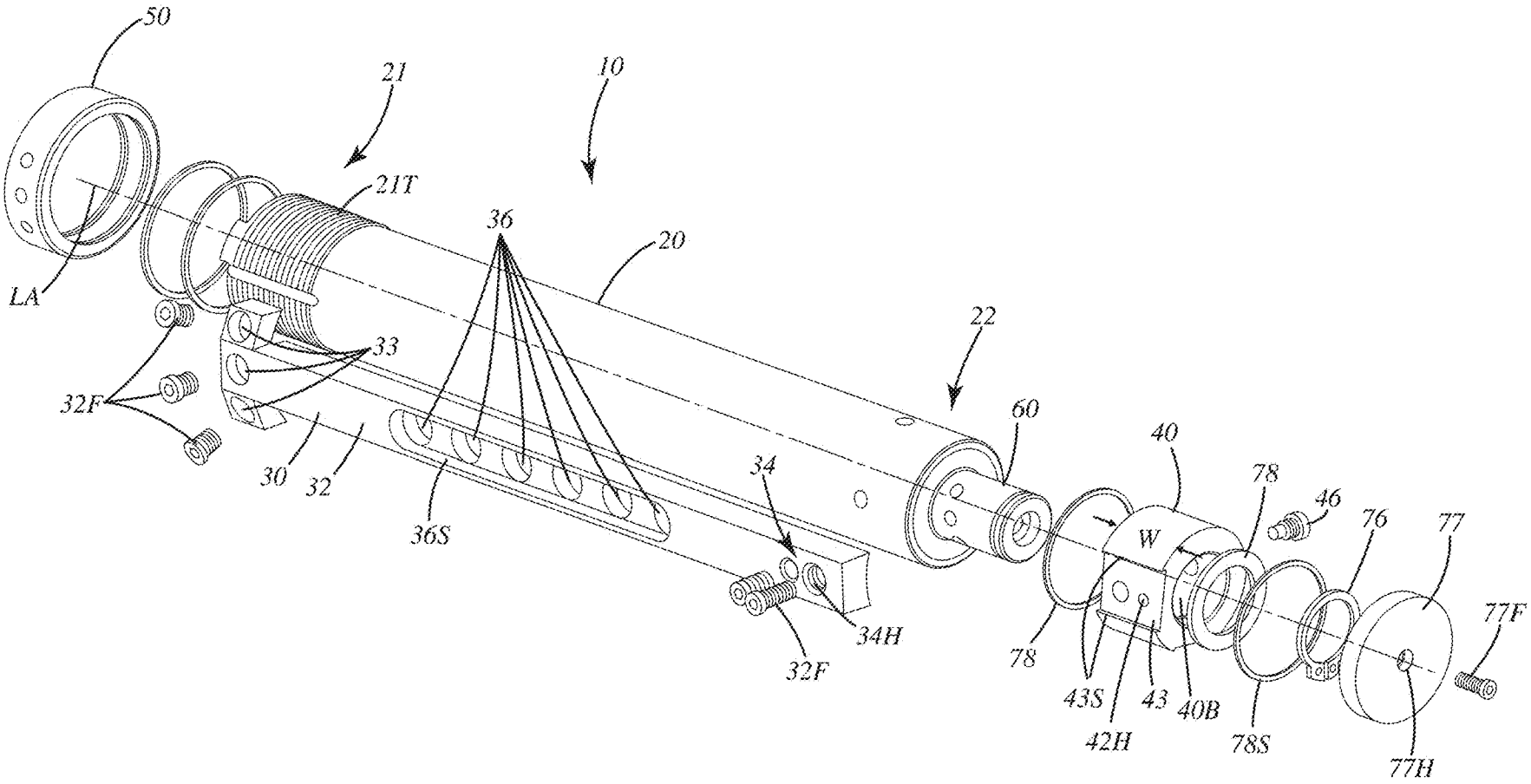
FIG. 4 is a lower exploded perspective view of the buttstock mount.
Figure 5:
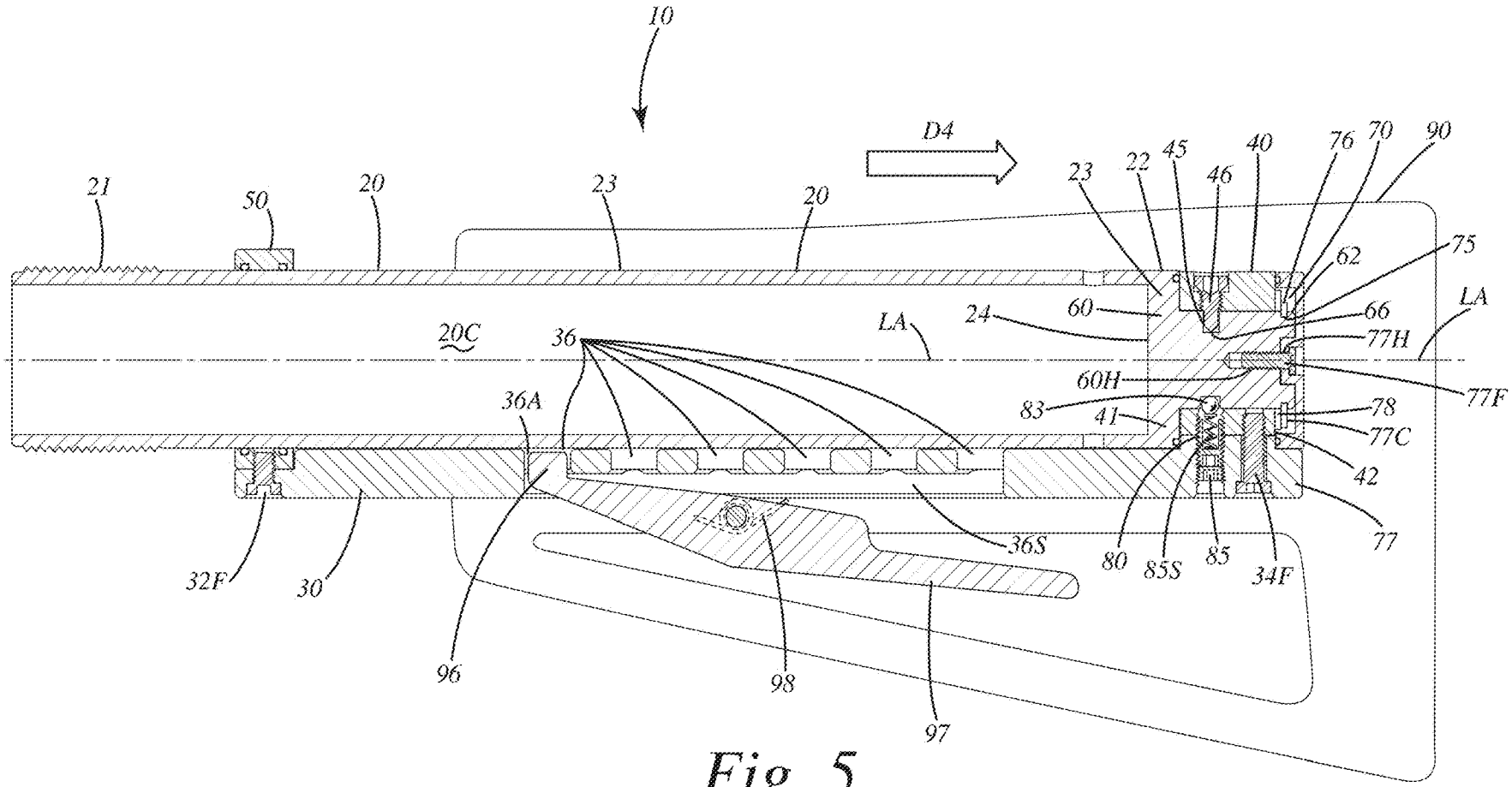
FIG. 5 is a section view of the buttstock mount.

As shown in FIGS. 3 and 4, the tube 20 can extend at its rearward end 22, which generally is closest to a user's shoulder when the weapon is shouldered, to a shoulder or step 23. At this step, the dimension or diameter of the tube or components thereof can reduce from a first dimension or diameter D1 to a second dimension or diameter D2 that is lesser than the first dimension D1. In some embodiments, the tube can be closed with a closure wall or cap 24 as shown in FIG. 5 such that the closure wall 24 closes off the internal compartment 20C of the tube 20. The tube 20 can transition to a boss 60 that projects from the rearward end 22 of the tube 20 and extends along the longitudinal axis LA of the tube and mount 10 in general, along with the buttstock and its internal compartment 93.

The support frame shown in FIGS. 3-4, can include a rearward ring 40 and a forward ring 50. The forward ring 50 can be disposed adjacent the forward end 21 of the tube 20 near the threads 21T but without overlapping those threads 21T. The forward ring 50 can define threaded fastener holes 52. The support frame 30 can include forward ring fasteners 32F that extend through corresponding holes 33 in the support rail 32 and into the threaded holes 52 of the forward ring 50. In this manner, the support rail 32 can be fastened to the forward ring 50 via the fasteners 32F. Of course, in other applications, the fasteners and holes can be reduced in number so that a single fastener secures the forward ring 50 to the rail 32. In other applications, these components can be integrally formed from a single piece of material. In yet other constructions, the ring can be locked via another mechanism to the rail.

Figure 6:
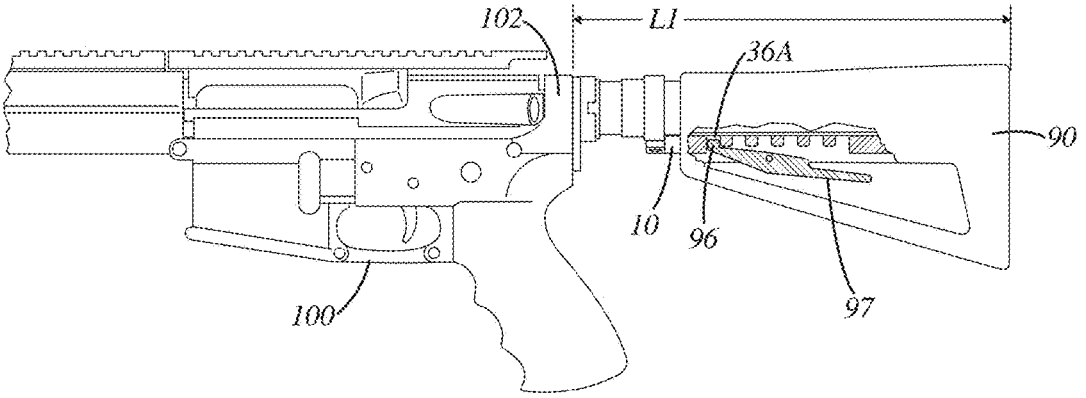
FIGS. 6-8 are views of the buttstock being extended different degrees using the buttstock mount.
Figure 7:
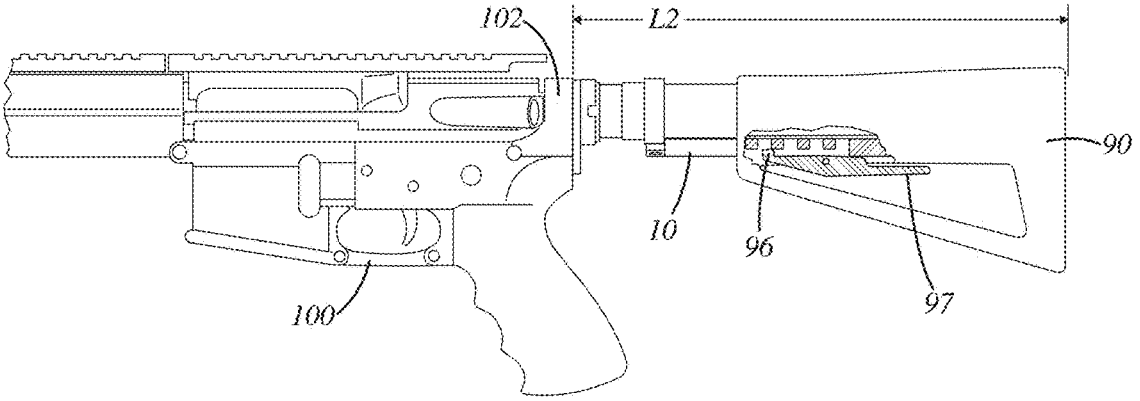
Figure 8:
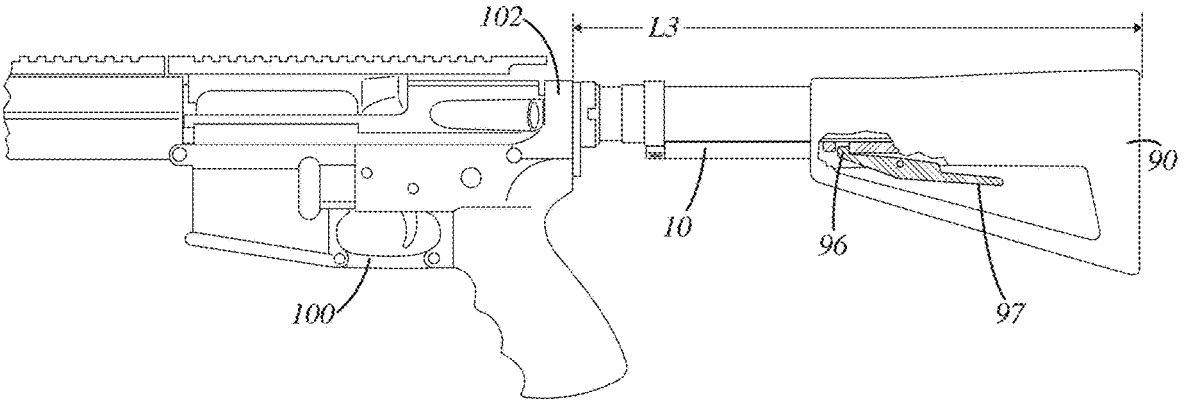

As further shown in FIGS. 3 and 4, the support frame can include a support bar 32 that extends rearward, generally parallel to the longitudinal axis LA along the middle portion 23. The rail can extend toward the rearward end 34 thereof. As it does, the interior portion 35 can be of a concave shape to mate with and correspond to the exterior of the tube 20, which as shown can be cylindrical. Of course, that portion 35 can be flat, planar or convex depending on the application. The middle portion 33 of the rail optionally can define one or more length adjustment components 36 which as shown can be in the form of recesses, holes and/or apertures, all referred to as recesses. These recesses can be of any configuration and generally can be commonly disposed in a common elongated slot 36S defined along the lower surface of the bar 32 of the support frame 30. The adjustment recesses 36 can be arranged along the tube and rail, in a line extending parallel to the longitudinal axis. The recesses can be positioned to be selectively engaged by a pin, post, bolt or other engager 96 of the buttstock 90. Upon engagement of these components, the length or extension of the buttstock 90 away from the received 102 or remainder of the weapon 100 can be fixed or locked. More generally, the stock 90 can be telescopically joined with the mount 10 to enable the buttstock 90 to be extended and retracted at varying lengths along the length of the tube 20. For example, as shown in FIGS. 6-8, the buttstock 90 can be extended to an exemplary first length L1 from the receiver 102 shown in FIG. 6 to a second length L2 from the receiver 102 shown in FIG. 7, and/or to a third length L3 from the receiver 102 shown in FIG. 8 and so on. The buttstock can be fixedly at these lengths via engagement of the engager or post 96 in one of the recesses 36 shown in FIG. 5. There, the pin 96 is disposed in a first recess 36A which can correspond to the first length L1. A user can depress a lever 97 which can withdraw the pin 96 from the recess 36A. The user can then extend or move the buttstock in direction D4 to lengthen the length of the buttstock, for example, to the length L2 shown in FIG. 7 or the length L3 shown in FIG. 8. When the pin moves, it optionally can be trapped in a slot or channel 36S so that the buttstock will not rotate relative to the tube 20. The user can release the lever 97 at which point the spring 98 can urge the engager or pin 96 into another of the recesses 36 corresponding to the lengths L2, L3 or some other length. To shorten the length of the buttstock, the opposite procedure can be followed. In this manner, the buttstock 90 is adjustable in length relative to the tube and can extend and retract different lengths and distances from the receiver 102 to fit the statures of a variety of users.

Returning to FIGS. 3 and 4, the support frame 30 can include a rearward portion 34. This rearward portion can be joined with the rearward ring 40. This attachment can be via a rearward fastener 34F that extends through a hole 34H of the rail 32. This fastener 34F can be threaded into a threaded hole 42H defined by the rearward ring 40. One or more additional rearward fasteners although not shown can be added to increase the strength of the coupling of the rail 32 to the rearward ring 40. The rearward ring 40 can include a land 43. This land can be substantially flat and/or planar as shown or can be convex or concave or of some other configuration matching a corresponding land 34L at the rear portion 34 of the bar 32. The land 34L of the bar 32 optionally can be flat or planar. The lands 34L and 43 can be placed adjacent one another. Further optionally, the ring 40 can include one or more steps or shoulders 43S that form recesses adjacent the land 43 within which the land 34L can be disposed and can align rather well. Of course, the ring 40 and rearward portion 34 of the bar can be outfitted with other structures, such as bosses, recesses, ridges or other components to assist in aligning and firmly securing the ring 40 to the bar 32. Yet further optionally, these components can be integrally formed as a single piece unit with one another. Of course, in some applications, combining the rearward ring 40 and the forward ring 50 with the bar 32 might increase raw material cost because a larger piece of material is machined or constructed to include these different components.

As shown in FIGS. 2-5, the forward ring 50 can extend completely around the exterior surface of the tube 20. In other applications, however, the forward ring 50 may extend only around a portion of the tube. In other applications, the ring might be absent from the frame 30. The rearward ring 40 can include and extend around a boss 60 that protrudes from the rearward end 22 of the tube 20. Optionally, the ring 40 may extend around only a portion of the outer surface of the boss 60. Further, although shown as a relatively wide ring having a width W, the rearward ring 40 can be reduced in that width dimension to be as small or smaller than width W2 of the forward ring 50. The width W of the rearward ring 40 can be optionally less than the height HB of the boss extending from the shoulder 23 to its rearmost portion or surface 62. In such a configuration, the rearward end 62 of the boss, distal from the forward end 61, optionally can comprise a retainer 70. The retainer can include an annular groove 75 that extends around the longitudinal axis LA and around the exterior of the boss 60. This annular groove can receive a clip 76 that extends around the boss 60 as well. The clip can be an E clip or a portion of a washer or other circumferential structure. Of course, the clip 76 can extend around a portion or all of the boss 60. The clip can include a front surface and a rearward surface. The front surface can face toward the rearward ring 40. The clip also can include an external dimension or diameter D5 that can be greater than the inner diameter D7 of the bore 40B of the rearward ring 40. Accordingly, the rearward surface 42 of the ring 40 can be disposed adjacent the clip and the clip can retain the rearward ring 40 on the boss, while allowing it to freely rotate about the boss 60 and the longitudinal axis LA.

Figure 9:
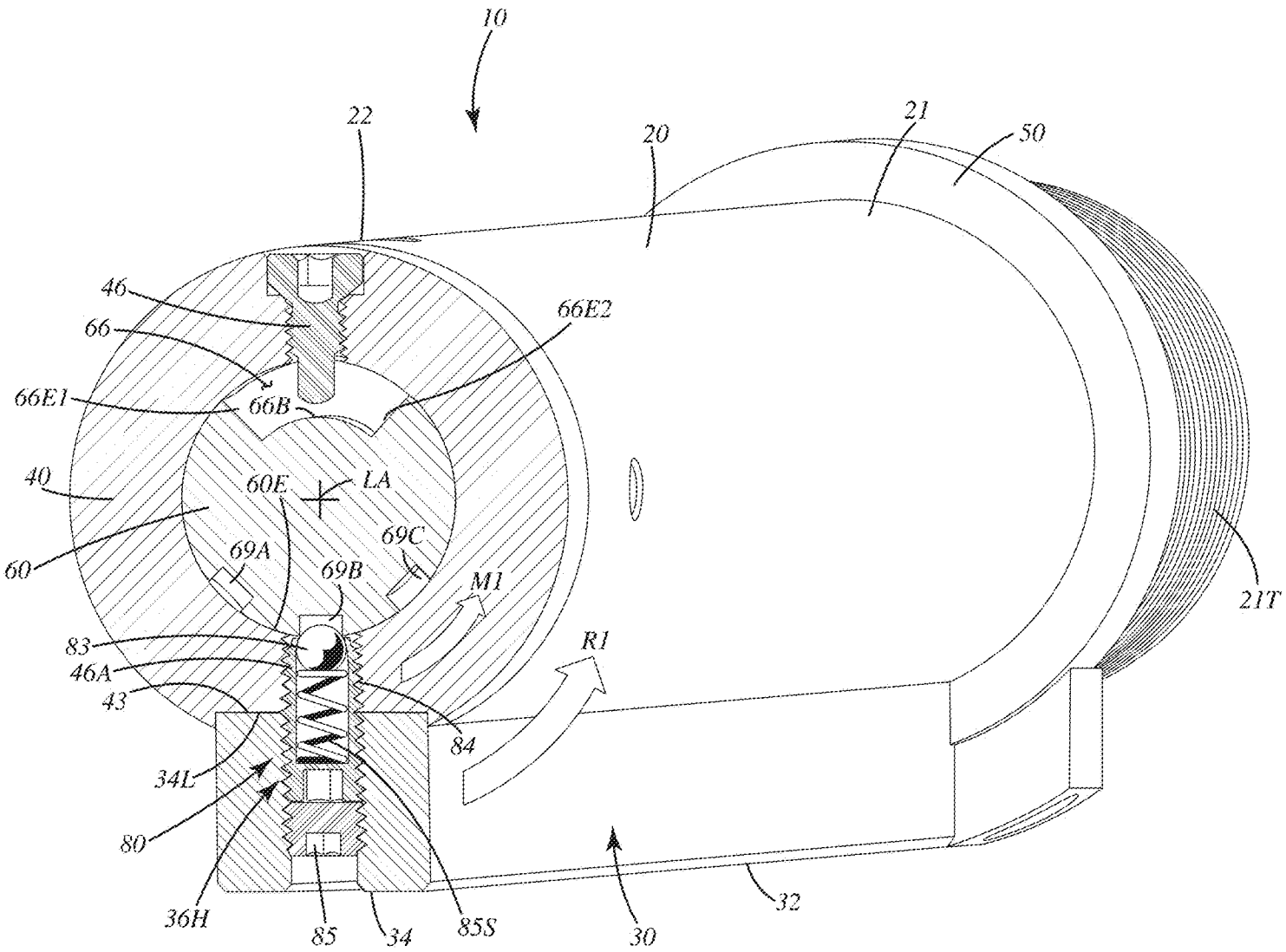
FIG. 9 is a section view of the buttstock mount in a first angular orientation.

Optionally, a washer 78 can be disposed between the rear surface 42 of the rearward ring 40 and the clip 76. This washer 78 can fully or partially circumferential the boss 60. This washer can be constructed from a low friction material, such as polished steel, stainless steel, high density polyethylene, polypropylene, Nylon 6, 6, or some other low friction polymer. This washer optionally can be disposed between the clip 76 and the rearward ring 40, optionally with the rearward ring front surface 42 directly engaging the washer 78. The forward surface 41 of the rearward ring 40 optionally can engage the rear surface or shoulder surface 23 adjacent the boss 60 so that the rearward ring 40 is not prone to completely free spin about the boss simply by rotating the tube 20. However, that rear ring 40 can be configured and constructed so that it does free spin when a small amount of rotational force or a moment M1 as shown in FIG. 9 is applied.

Optionally, the compressive force on the rearward ring 40 can be such that the firearm or weapon 100 can be rotated about the longitudinal axis, and the buttstock, rearward ring and support will rotate simultaneously with that remainder of the firearm. However, when a user applies a moment M1 of optionally 0.25 foot pounds, 0.5 foot pounds, 1 foot pound, 2 foot pounds, 3 foot pounds, 4 foot pounds, 5 foot pounds or some other moment greater than zero on the buttstock and the support frame, the support frame, rearward ring, and buttstock will rotate in the direction of the moment. In this construction, however, no other movement of the rearward ring, support frame or buttstock is implemented. For example, the buttstock, rearward ring, and frame do not need to be moved longitudinally along the tube toward or away from the receiver or the remainder of the weapon to enable those components to rotate around the longitudinal access LA of the tube and mount 10.

Returning to FIGS. 3-5, the boss 60 as mentioned above extends rearward from the shoulder or rearward surface 23 of the tube 20. The clip can be secured adjacent the washer, which can be adjacent the rearward ring 40. Optional seals 78S and 79S can be disposed forward and rearward of the rearward ring 40. This can prevent dust, dirt, debris and other contaminants from entering between the bearing surface of the boss 60 and the internal bore 40B of the rearward ring 40. Of course, these seals can come in a variety of forms, such as rubber, silicone or elastomeric washers, O-rings or other sealing elements. In other applications, these seals can be completely absent from the construction.

As shown in FIGS. 3-5, the mount 10 can optionally include a cap or cover 77. This cap 77 can define a hole 77H. A fastener 77F extends through the hole and further into a cap fastener hole 60H that is defined by the boss 60. The fastener 77F can be threaded into corresponding threads of the cap fastener hole 60H and can secure the cap 77 to the distal end of the boss 60 and generally to the tube 20. The cap 77F can be tightened to the boss so that the seals 78S and 79S engage the cap and rearward ring 40, as well as the rearward ring and shoulder or surface 23 as shown in FIG. 5. This can provide a dust, dirt and debris barrier to the internal components of the mount. The cap 77 can further create and define an internal compartment 77C within which the optional clip 76 and the optional washer 78 can be disposed. In some cases, the clip 76 and washer 78 can be eliminated, and the cap 77 can be reinforced and directly abut or be in contact with the rearward ring 40, holding that rearward ring on the boss. In other applications, the cap 77 itself can include an integral boss and a fastener can extend through the cap and the integral boss into a threaded or other hole on the closure wall 24 of the tube 20, thereby securing the boss to the tube, with the rearward ring 40 trapped between the cap and the shoulder 23 or second end 22 of the tube to provide for rotational and axial rotational displacement and movement of the rearward ring, and support frame relative to the tube, during which these components can rotate about the longitudinal axis to varying degrees.

Axial rotation of the support frame 30 and an associated buttstock 90 that is joined with the support frame and/or the mount 10 optionally can be controlled and limited via the interface of the rear ring 40 and the boss 60. For example, as shown in FIGS. 3-5, the boss and/or support frame can include a guide 45. This guide 45 can provide and optionally limit the amount of axial rotation about the longitudinal axis of the support frame, rearward ring and support frame and thus the buttstock 70 that is joined with the support frame and/or tube 20. The guide 45 optionally can include a guide pin 46 that projects into or otherwise interfaces with a guide slot 66. These components can provide a rotational interface about the longitudinal access LA between the boss and the rearward ring. The rearward ring can rotate about the longitudinal axis in a rotation mode. In the rotation mode, the ring, support frame and/or buttstock 90 can rotate about the longitudinal axis, optionally without moving axially along the longitudinal axis LA in any part of the rotation mode, or a hold or locked mode as described below.

The guide slot 66 can extend linearly from a left side of the tube to a right side of the tube or vice versa. The guide slot 66 can extend from a first end 66E1 to a second end 66E2. Each of these ends can be radiused and/or include a closure to the end of the slot preventing or impairing the guide pin from moving past these ends during a rotational movement. In some cases, the pin optionally can move all the way to the ends 66E1 or 66E2 and abut or engage those ends, thereby ceasing any rotation about the longitudinal axis LA of the frame 30 and the associated buttstock 90. The guide slot 66 can, however, curve around the longitudinal axis LA from the first end to the second end. For example, as shown in FIG. 9, the guide slot 66 can curve around the longitudinal axis LA with the bottom 66B of the groove or slot 66 being equidistant from the longitudinal axis LA along the length of the slot from one end to another. The guide slot 66 can be linear and unbranched, that is, optionally it might not include any portions that enable the guide pin 46 to move linearly along or parallel to the longitudinal axis LA. Of course, in other applications, the guide slot 66 can simply be a grove or cut that extends partway through the boss 60. In this application, the material of the boss is removed for a portion extending inward from the exterior surface of the boss.

Figure 10:
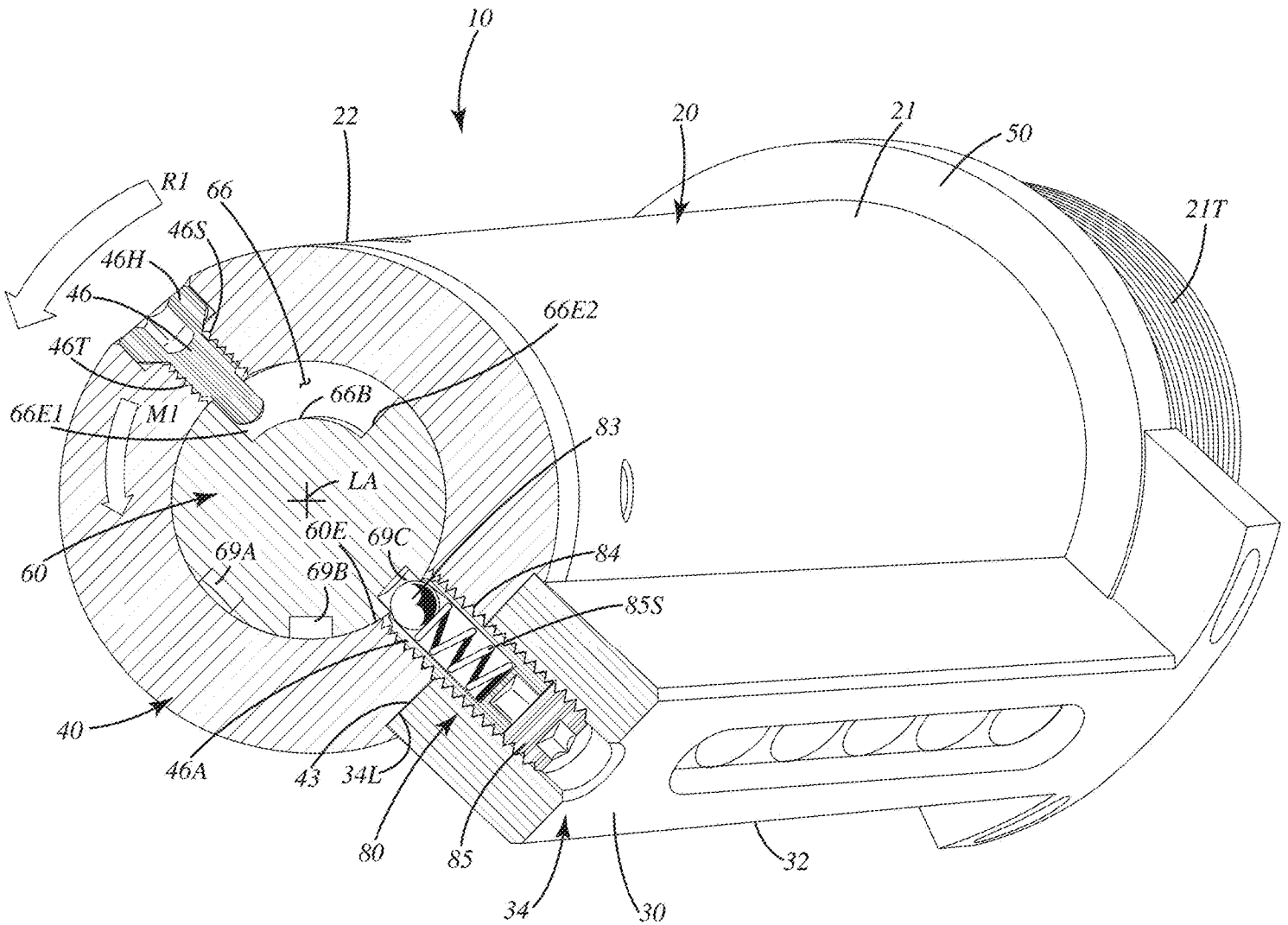
FIG. 10 is another section view of the buttstock mount in a second angular orientation.

As shown in FIG. 10, the current embodiment can include the groove 66 having ends 66E1 and 66E2, which form walls that extend generally radially away from the longitudinal axis LA. Thus, when the guide pin 46 engages those walls, the post 46P of the guide pin 46 can be generally parallel to the walls of the end. As further shown in FIG. 10, the guide slot 66 can extend through an angle of approximately 45° disposed above the longitudinal axis LA. Of course, in other applications, the guides slot 66 can extend through different or greater angles, for example, 90°, 180° or 240° around the axis LA. Further, although shown as being disposed in the upper quadrants of the boss above the longitudinal axis LA, the guide slot 66 can be disposed on the lower portion of the boss 60 or on the sides of the boss. Likewise, the guide pin 46 might extend inward through the support frame 30 and engage the guide slot 66 along a bottom portion of the mount 10 adjacent the support frame. Other constructions and locations are contemplated for the guides slot 66.

With further reference to FIGS. 9 and 10, the guide pin 46 optionally can be of a particular construction. The guide pin can be in the form of a fastener having a fastener head 46H that transitions to a threaded shaft 46S. The ring 40 can include a fastener hole 41H that receives the threads 46T of the guide pin 46. The post 46P can extend from the shaft 46S of the guide pin 46. This post can be movably disposed within the guide slot 66 without the shaft 46 extending into that guide slot. Of course, in some applications, the guide pin 46 with its structure can be replaced with a simple pin that is pressed, glued or friction fit in a hole 41H of the rearward ring 60, pounded in place and permanently set. In other applications, the guide pin can be threaded to the inner distal end thereof from the head 46H. The threads can be disposed in the groove.

Figure 13:
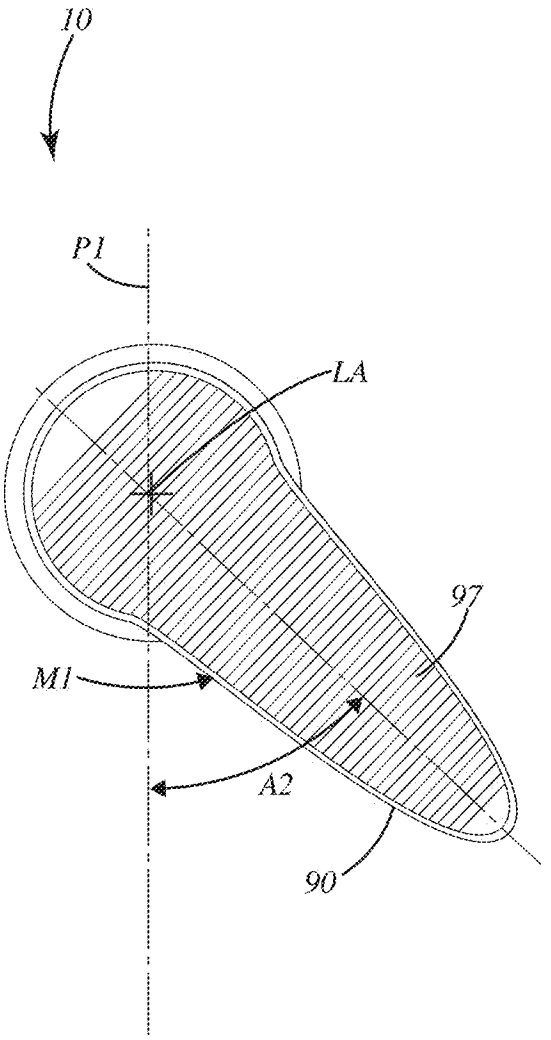
FIGS. 11-13 are rear views of the buttstock being set in different angular orientations using the buttstock mount.
Figure 12:
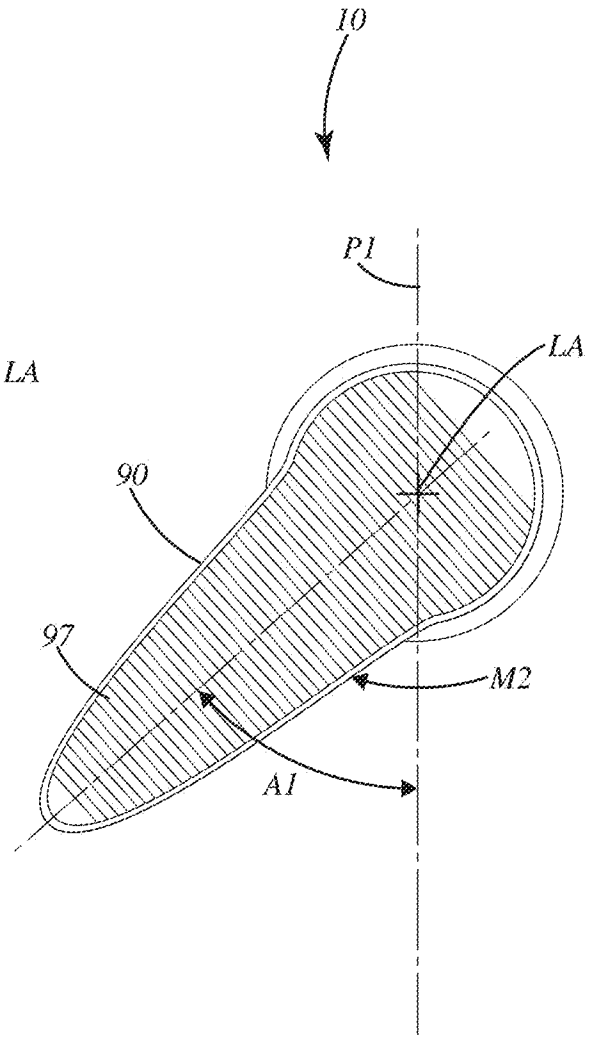
Figure 11:
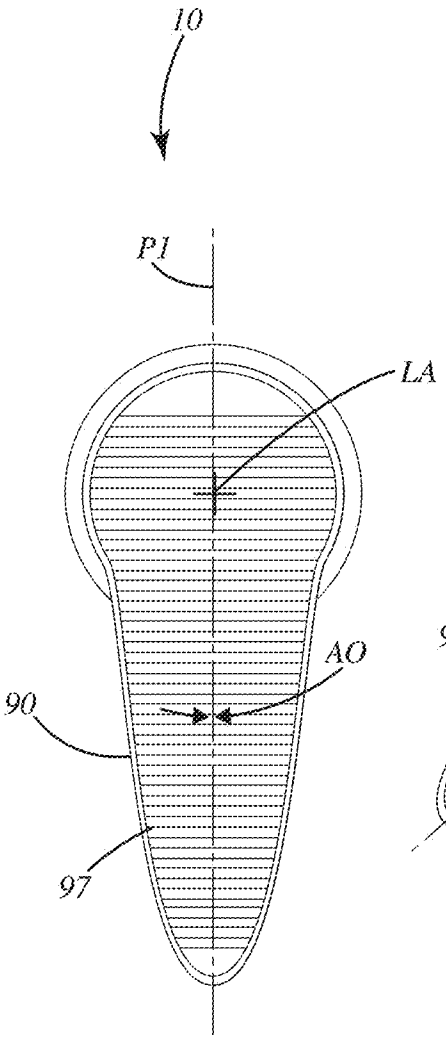

The guide pin and guide slot again can operate to limit the rotation of the rearward ring 40 about the boss 60 and thus the support frame 30 relative to the tube 20, and thus further the rotation of the buttstock 90 secured to the mount 10. For example, when the guide pin 46 is in the orientation shown in FIG. 9 within the guide slot 66, the associated support frame 30 joined with the buttstock 90 can be in the upright or downward extending configuration shown in FIG. 11. There, the buttstock 90 and its pad 97 are disposed in a vertical orientation when the firearm 100 is vertical. This can correspond to an angle A0 which is about 0° relative to a centerline or plane P1 that bisects the mount 10 and/or firearm 100 into corresponding lateral sides. When the user exerts a moment M1 on the buttstock as shown in FIGS. 9 and 13, the rearward ring 40, frame 30 and associated buttstock 90 and pad 97 rotate indirect R1. The rotation can cease when the guide pin 46 engages the end 66E of the guide slot 66. The pad 97 and buttstock 90 can attain the configuration shown in FIG. 13 where the pad centerline is at an angle A2 relative to the P1. This angle A2 can be optionally 10°, 20°, 30°, 40°, 45°, 50°°, 60° 70°, 80°, 90° or other angles up to 180° from the plane P1. The rotation can be limited by engagement of the guide pin 46 with the end of the slot 66. If the user exerts an opposite moment, M2 on the buttstock, the buttstock 90 and the pad 97 can rotate in direction R2, in which case the post 46P again moves in the slot, but in the opposite direction R2 until it engages the end 66E2. At this point, the movement of the pad 97 can cease at an angle A1 relative to the centerline or plane P1. This angle can be optionally the opposite of those angles mentioned above. Again, the guide slot and guide pin can be moved around the longitudinal axis to accommodate specific desired angular orientations of the buttstock and movement motions to achieve those angular orientations for a user.

Optionally, the mount 20 can include a detent interface or mechanism 80, which can assist in setting the rearward ring, support frame in an associated buttstock 90 at one or more predetermined angles about the longitudinal axis. This detent interface can include a plurality of recesses 69A, 69B, 69C disposed on or formed or defined by the boss 60. These recesses can be opposite the guide slot 66. These recesses also can correspond to the limits of the ends of the guide slot 66. For example, the recess 67C can correspond to the end 66E1 of the guide slot and the recess 69A correspond to the end 66E2 of the guide slot 66. Thus, when the guide pin 46 engages the end 66E1, the detent can also correspondingly engage the recess 69C to provide extra holding force for the buttstock at a predetermined angle for example A2 in FIG. 13.

Optionally, the detent interface or mechanism 80 can include a sleeve 84 that houses a ball 83 that is trapped within the sleeve in an internal department. A spring 83 can urge the ball toward the opening of the sleeve 84. The ball 83 can project partially beyond the opening of the sleeve 84 allowing the ball to be biased a small distance outside the sleeve 84. The ball also can roll relative to or on the exterior surface of the boss, between the recesses 69A, 69B, 69C depending on the angular orientation of the rearward ring relative to the boss. The ball 83 can be biased at least partially into one of those recesses 69A, 69B, 69C after traversing the exterior surface of the boss. The ball 83 can thus at least partially or fully enter a corresponding recess and act as a lock to temporarily lock the rearward ring relative to the 60, and thus the support frame 30 and the associated buttstock 90 relative to the tube 20 in a predetermined angular orientation sufficient for the user to shoulder the weapon in a particular shooting stance. The detent interface also can provide audible clicks when the ball 83 enters the respective recesses 69A, 69B, 69C to inform the user that the buttstock has rotated and is in a particular angular orientation relative to the tube and/or the weapon.

Optionally, although only three recesses for three specific angular orientations of the buttstock are included in the boss 16, additional or fewer recesses can be included for other angular orientations. Moreover, these recesses can be disposed along a plane to which the longitudinal axis LA is orthogonal. Further optionally, although the detent, sleeve and ball are shown as being associated with the support frame and/or rearward ring, that structure alternatively can be associated with the boss 60 with the internal bore of the rearward ring instead defining the detent recesses. Further optionally, the detent interface 80 can be secured and threaded in the respective holes of the support frame and rearward ring as shown. In some applications, an additional set screw 85 can be engaged against the sleeve to secure the detent interface in and relative to the support frame and the rearward ring 60. It will further be appreciated that other locking mechanisms, such as a cam mechanism, a set screw, a loaded pin, or other structures can replace the detent interface 80 to provide a secondary locking mechanism by assisting user in holding the rearward ring, support frame and associated buttstock in a predetermined or selected angular orientation, relative to the tube and the firearm.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Additionally, the particular features, structures, or characteristics of one embodiment are contemplated for proper and full combination in any suitable manner in one or more other embodiments, which is fully contemplated herein. Further, features, structures, or characteristics of one embodiment or multiple embodiments are readily and completely mixed and matched with any features, structures, or characteristics of any other embodiment or multiple embodiments in varying combinations and permutations.

What is claimed is:

1. A rotatable buttstock mount for a weapon comprising:

a tube configured for attachment to the weapon, the tube including a forward end and a rearward end, the tube including a longitudinal axis;

a boss projecting from the rearward end of the tube and extending along the longitudinal axis, the boss defining a guide slot that is transverse to the longitudinal axis and linear along an entire length of the guide slot; and a support frame including a forward ring extending around the forward end of the tube, a bar extending rearward from the forward ring and joined with a rearward ring, the rearward ring extending around the boss and including a guide pin projecting in the guide slot, the rearward ring and the guide pin being axially rotatable about the longitudinal axis in a rotation mode, whereby an angle of a buttstock, when joined with the support frame, is alterable relative to the tube, to thereby accommodate an orientation of the buttstock interfaced between the user and the weapon.

2. The rotatable buttstock mount of claim 1, wherein the boss projects from a shoulder, wherein the guide pin and guide slot are maintained at a fixed distance from the shoulder in the rotation mode.

3. The rotatable buttstock mount of claim 1 comprising:

a clip disposed at a distal end of the boss, wherein the clip extends outward around the boss, wherein the clip traps the rearward ring on the boss.

4. The rotatable buttstock mount of claim 1, wherein the support frame and the boss include a detent interface including a bearing and a plurality of recesses disposed around the longitudinal axis and configured to selectively receive the bearing, thereby fixing the rearward ring in at least two different angular orientations relative to the tube, whereby the angle of the buttstock when joined with the support frame can be fixed at the at least two different angular orientations relative to the tube.

5. The rotatable buttstock mount of claim 1, wherein the guide pin includes a fastener portion threaded into a hole defined by the rearward ring extending radially toward the longitudinal axis, wherein the guide pin includes a shaft that extends into the guide slot beyond a thread of the fastener portion.

6. The rotatable buttstock mount of claim 1, wherein the bar is in the form of a rail with a plurality of positioning holes configured to interface with a positioning pin of the buttstock when joined with the support frame, wherein the rail is secured to the forward ring with a forward ring fastener, wherein the rail is secured to the rearward ring with a rearward ring fastener.

7. The rotatable buttstock mount of claim 6, wherein the rearward ring includes a flat land, wherein the rail engages the flat land, wherein the rearward ring fastener extends through the rail and in a threaded hole defined by the rearward ring to secure the rail to the rearward ring.

8. The rotatable buttstock mount of claim 1 comprising:

a cap joined with the boss rearward of the boss; and a fastener extending through the cap and threadably joined with the boss to join the cap with the boss.

9. The rotatable buttstock mount of claim 1 comprising:

a retainer coupled to the boss rearward of the rearward ring such that the rearward ring cannot be disengaged from the boss due to interference of the rearward ring with the retainer.

10. The rotatable buttstock mount of claim 9, wherein the retainer is a clip engaged with the boss, wherein the guide slot is perpendicular to the longitudinal axis, wherein the guide slot includes a first end and an opposing second end, wherein the first end and second end are rounded, with the guide slot being linear between the first end and second end, the guide slot being unbranched, wherein the first end is disposed to the left of the longitudinal axis, wherein the second end is disposed to the right of the longitudinal axis, wherein the guide pin moves along a fixed arc around the longitudinal axis, without moving axially along the longitudinal axis, in the rotation mode, and in a hold mode after the buttstock is positioned at an angular orientation, wherein the boss and the rearward ring remain at a fixed distance from the tube in the rotation mode and in the hold mode.

11. A rotatable buttstock mount for a weapon comprising:

a tube configured for attachment to the weapon, the tube including a forward end that is threaded and a rearward end, the tube including a longitudinal axis;

a boss joined with the tube and extending along the longitudinal axis, the boss defining a guide slot that is transverse to the longitudinal axis;

a rearward ring extending around the boss and including a guide pin projecting toward the longitudinal axis in the guide slot, the rearward ring and the guide pin being axially rotatable about the longitudinal axis in a rotation mode, the guide slot including a first end and a second end that limit the angular rotation of the rearward ring relative to the tube, whereby an orientation of a buttstock that is joinable with the rearward ring can be altered via angular rotation of the rearward ring about the longitudinal axis.

12. The rotatable buttstock mount of claim 11 comprising:

a rail extending forward of the rearward ring, a forward ring extending around the tube forward of the boss, a buttstock joined with the rearward ring and slidably interfaced with the rail to provide variable extension of the buttstock relative to the tube.

13. The rotatable buttstock mount of claim 12, wherein the rail is secured to the rearward ring with a rearward ring fastener, wherein the rail is secured to the forward ring rail with a forward ring fastener.

14. The rotatable buttstock mount of claim 13, wherein the boss defines a plurality of detent recesses, wherein the rearward ring includes a detent including a bearing selectively disposable in at least one of the plurality of detent recesses to set an angle of the buttstock relative to the tube.

15. The rotatable buttstock mount of claim 11, wherein the guide pin includes a threaded shaft having a head at a first end and a post at a second end, wherein the post is journaled in the guide slot and the threaded shaft is outside the guide slot.

16. The rotatable buttstock mount of claim 11 comprising:

a cap mounted to the boss such that the rearward ring is rotatably mounted between the cap and the tube.

17. A rotatable buttstock mount for a weapon comprising:

a tube configured for attachment to the weapon, the tube including a forward end and a rearward end, the tube including a longitudinal axis;

a boss projecting from the rearward end of the tube and extending along the longitudinal axis; and a support frame including a forward ring extending around the forward end of the tube, a bar extending rearward from the forward ring and joined with a rearward ring, the rearward ring extending around the boss;

a guide pin projecting in a guide slot to provide a rotational interface about the axis between the boss and the rearward ring, the rearward ring being axially rotatable about the longitudinal axis in a rotation mode, whereby an angle of a buttstock when joined with the support frame is alterable relative to the tube, to thereby accommodate an orientation of the buttstock interfaced between the user and the weapon.

18. The rotatable buttstock mount of claim 17, wherein the guide slot is perpendicular to the longitudinal axis, wherein the guide slot includes a first end and an opposing second end, wherein the first end is disposed to the left of the longitudinal axis, wherein the second end is disposed to the right of the longitudinal axis, wherein the guide pin moves along a fixed arc around the longitudinal axis, without moving axially along the longitudinal axis, in the rotation mode, and in a hold mode after the buttstock is positioned at an angular orientation, wherein the boss and the rearward ring remain at a fixed distance from the tube in the rotation mode and in the hold mode.

19. The rotatable buttstock mount of claim 18 comprising:

wherein the guide pin includes a threaded shaft having a head at a first end and a post at a second end, wherein the post is journaled in the guide slot and the threaded shaft is outside the guide slot.

20. The rotatable buttstock mount of claim 19, wherein the guide slot is unbranched and linear and curving around the longitudinal axis.

* * * * *